United States Patent [19]

Izaki et al.

[11] Patent Number: 4,910,095

[45] Date of Patent: Mar. 20, 1990

[54] HIGH CORROSION RESISTANT PLATED COMPOSITE STEEL STRIP

[75] Inventors: Teruaki Izaki; Makoto Yoshida; Masami Osawa; Seijun Higuchi; Sato Hisaaki, all of Kitakyushu, Japan

[73] Assignee: Nippon Steel Corporation, Tokyo, Japan

[21] Appl. No.: 284,120

[22] Filed: Dec. 14, 1988

[30] Foreign Application Priority Data

| | | | |
|---|---|---|---|
| Dec. 29, 1987 | [JP] | Japan | 62-334055 |
| Dec. 29, 1987 | [JP] | Japan | 62-334056 |
| Dec. 29, 1987 | [JP] | Japan | 62-334057 |
| Dec. 29, 1987 | [JP] | Japan | 62-334058 |

[51] Int. Cl.[4] ..... B32B 15/04; B32B 15/18

[52] U.S. Cl. ..... 428/623; 428/626; 428/632; 428/633; 428/659; 428/935

[58] Field of Search ..... 428/623, 626, 632, 633, 428/659, 935

[56] References Cited

U.S. PATENT DOCUMENTS

| | | | |
|---|---|---|---|
| 3,791,801 | 2/1974 | Ariga et al. | 428/659 |
| 4,407,899 | 10/1983 | Hara et al. | 428/626 |
| 4,524,111 | 6/1985 | Oka et al. | 428/659 |
| 4,775,600 | 10/1988 | Adaniya et al. | 428/659 |
| 4,800,134 | 1/1989 | Izaki et al. | 428/626 |

FOREIGN PATENT DOCUMENTS

| | | | |
|---|---|---|---|
| 174019 | 3/1986 | European Pat. Off. | 428/659 |

*Primary Examiner*—Robert McDowell

*Attorney, Agent, or Firm*—Wenderoth, Lind & Ponack

[57] ABSTRACT

An electroplated composite steel strip having a high corrosion resistance comprises a steel strip substrate and a corrosion resistant coating layer which comprises at least a base plating layer comprising a zinc-based metal matrix, a number of corrosion-preventing fine solid particles consisting essentially of core fine particles of, for example, chromate, phosphate, aluminum, molybdenum or titanium compounds, and encapsulated by very thin coating membranes consisting of, for example, $SiO_2$, $Al_2O_3$, $ZrO_2$ or $TiO_2$, and optionally a number of additional fine particles consisting essentially of, for example, $SiO_2$, $TiO_2$, $Cr_2O_3$, $Al_2O_3$, $ZrO_2$, $SnO_2$ or $Sb_2O_5$.

13 Claims, 5 Drawing Sheets

HIGH CORROSION RESISTANT PLATED COMPOSITE STEEL STRIP

BACKGROUND OF THE INVENTION

1. Field of the Invention

The present invention relates to a high corrosion resistant plated composite steel strip and a method of producing the same. More particularly, the present invention relates to a corrosion resistant plated composite steel strip having a corrosion-preventing zinc-based plating layer containing corrosion-preventing fine particles in the form of microcapsules having a very thin coating membrane, and a method of producing the same.

2. Description of the Related Art

It is known that, in the winter in North America and Europe, the freezing (icing) of road surfaces is prevented by sprinkling rock salt powder or calcium chloride powder on the road surface, and that the above mentioned icing-preventing material causes corrosion and rusting of the bodies of cars traveling on those roads.

Accordingly, there is a demand for a high corrosion resistant plated steel strip for car bodies which can be used under the above-mentioned circumstances, without allowing the forming of red rust on the car bodies, over a long period.

There are two approaches for meeting the above-mentioned demand.

In countries, for example, the U.S.A. and Canada, where the cost of electricity is relatively low, the corrosion resistance of the steel strip is promoted by forming a thick corrosion resistant coating layer on the steel strip. This thick coating layer, however, causes the resultant coated steel strip to exhibit a reduced weldability, paint adhesion, and plating properties.

In other countries, for example, Japan, where electricity is expensive and enhanced weldability, paint adhesion, and plating properties are required for the steel strip to be used for car bodies, a plated steel strip having a thin corrosion resistant electroplating layer has been developed.

The plated steel strip of the present invention belongs to the above-mentioned category of plated steel strips having a thin corrosion resistant electroplating layer.

In this type of conventional electroplated steel strip having a thin electroplating layer, a zinc alloy, for example, a zinc-iron, zinc-nickel of zinc-manganese alloy, is plated on a steel strip substrate, or zinc or a zinc-nickel alloy is electroplated on a steel strip substrate and a chromate treatment and an organic resinous paint are then applied to the electroplating layer. The zinc alloy-electroplated or zinc or zinc alloy-electroplated and painted steel strips have a thin coating layer at a weight of 20–30 g/m$^2$. The conventional electroplated steel strips having the above-mentioned thin coating layer are not considered satisfactory for attaining the object of the domestic and foreign car manufacturers, i.e., that the car bodies should exhibit a resistance to corrosion to an extent such that rust does not form on the outer surfaces of the car bodies over a period of use of at least 5 years, and perforation from the outer and inner surfaces of the car bodies does not occur over a period of use of at least 10 years. In particular, a 10 year resistance to perforation is demanded.

Under the above-mentioned circumstances, investigations have been made into ways and means of obtaining a high corrosion resistant steel strip having a coating layer in which corrosion resistive fine solid particles are co-deposited with a plating metal matrix and are evenly dispersed within the plating metal matrix, i.e., a high corrosion resistant plated composite steel strip.

The co-deposited, dispersed fine solid particles can impart various properties to the plating layer of the plated composite steel strip, and thus this co-deposition type plating method has been developed as a new functional plating method. Namely, this type of plating method has been recently disclosed in Japanese Unexamined Patent Publication Nos. 60-96786, 60-211094, 60-211095 and 60-211096.

Japanese Unexamined Patent Publication No. 60-96786 discloses a method of producing a plated composite steel strip in which fine solid particles of rust-resistant pigments, for example, $PbCrO_4$, $SrCrO_4$, $ZnCrO_4$, $BaCrO_4$, $Zn_3(PO_4)_2$ are co-deposited with a plating metal matrix, for example, Zn or a Zn-Ni alloy, to be evenly dispersed in the plating metal matrix. This type of plated composite steel strip is considered to have an enhanced resistance to rust and perforation. Nevertheless, according to the results of a study by the inventors of the present invention, the plated composite steel strip of Japanese Unexamined Patent Publication No. 60-96786, in which the fine solid particles dispersed in the plating layer consist of rust-resistant pigments consisting of substantially water-insoluble chromates, for example, $PbCrO_4$, $SrCrO_4$, $ZnCrO_4$ or $BaCrO_4$, cannot realize the above-mentioned corrosion resistance level of no rust for at least 5 years and no perforation for at least 10 years. This will be explained in detail hereinafter.

Generally, the rust resistant fine pigment particles of the substantially water-insoluble chromates dispersed in a zinc-plating liquid exhibit a surface potential of approximately zero, and accordingly, when a steel strip is placed as a cathode in the zinc-plating liquid and is electrolytically treated, zinc ions are selectively deposited on the steel strip surface but there is a resistance to the deposition of the rust resistant fine pigment particles into the zinc-plating layer, and therefore, it is very difficult to obtain a plated composite steel strip having an enhanced corrosion resistance.

Japanese Unexamined Patent Publication No. 60-211095 discloses a plated composite steel strip having a Zn-Ni alloy plating layer in which fine solid particles of metallic chromium, alumina ($Al_2O_3$) or silica ($SiO_2$) are co-deposited with and dispersed in a Zn-Ni alloy matrix. According to the disclosure of this Japanese Publication, the metallic chromium is obtained from chromium chloride ($CrCl_3$), i.e., chromium chloride is dissolved in the plating liquid and releases chromium ions ($Cr^{3+}$), and when the steel strip is immersed and electrolytically plated as a cathode in the plating liquid, metallic chromium particles and chromium oxide ($Cr_2O_3.nH_2O$) particles are deposited into the plating layer to form a Zn-Ni alloy plating layer containing metallic chromium (Cr) and chromium oxide ($Cr_2O_3.nH_2O$) particles.

When alumina or silica particles are further co-deposited into the Zn-Ni-Cr-$Cr_2O_3.nH_2O$ plating layer, the resultant plated composite steel strip exhibits an enhanced corrosion resistance compared with the plated composite steel having the Zn-Ni-Cr-$Cr_2O_3.nH_2O$ layer, but the degree of enhancement of the corrosion resistance is small, and the $Al_2O_3$ or $SiO_2$ particle-containing, plated composite steel strip cannot realize a perforation resistance for at least 10 years.

Under the above-mentioned circumstances, it is desired by industry, especially the car industry, that a high corrosion resistant plated composite steel strip having a rust resistance for at least 5 years and a perforation resistance for at least 10 years, and a method of producing the same, be provided.

SUMMARY OF THE INVENTION

An object of the present invention is to provide a high corrosion resistant plated composite steel strip having an enhanced rust resistance for a period of at least 5 years and a perforation resistance for a period of at least 10 years, and a method of producing the same.

The above-mentioned object can be attained by the high corrosion resistant plated composite steel strip of the present invention which comprises:

(A) a substrate consisting of a steel strip; and (B) at least one corrosion resistant coating layer formed on at least one surface of the steel strip substrate and comprising a base plating layer which comprises (a) a matrix consisting of a member selected from the group consisting of zinc and zinc alloys; and (b) a number of corrosion-preventing fine solid particles dispersed in the matrix and consisting essentially of fine core solid particles encapsulated by very thin organic or inorganic membranes.

The fine core inorganic solid particles preferably comprise at least one member selected from the group consisting of chromates, aluminum compounds, phosphates, molybdenum compounds and titanium compounds.

The high corrosion resistant plated composite steel strip mentioned above is produced by the method of the present invention which comprises, coating at least one surface of a substrate consisting of a descaled steel strip by at least first electroplating the substrate surface with a first electroplating liquid containing (a) matrix-forming metal ions selected from the group consisting of zinc ions and mixtures of ions of zinc and at least one metal other than zinc to be alloyed with zinc, (b) a number of corrosion-preventing fine solid particles dispersed in the electroplating liquid and consisting of fine core solid particles encapsulated by very thin organic or inorganic coating membranes, and (c) a co-deposition-promoting agent for promoting the co-deposition of the corrosion-preventing fine particles together with the matrix-forming method, to form a base plating layer on the substrate surface.

DESCRIPTION OF THE PREFERRED EMBODIMENTS

Figure 1:
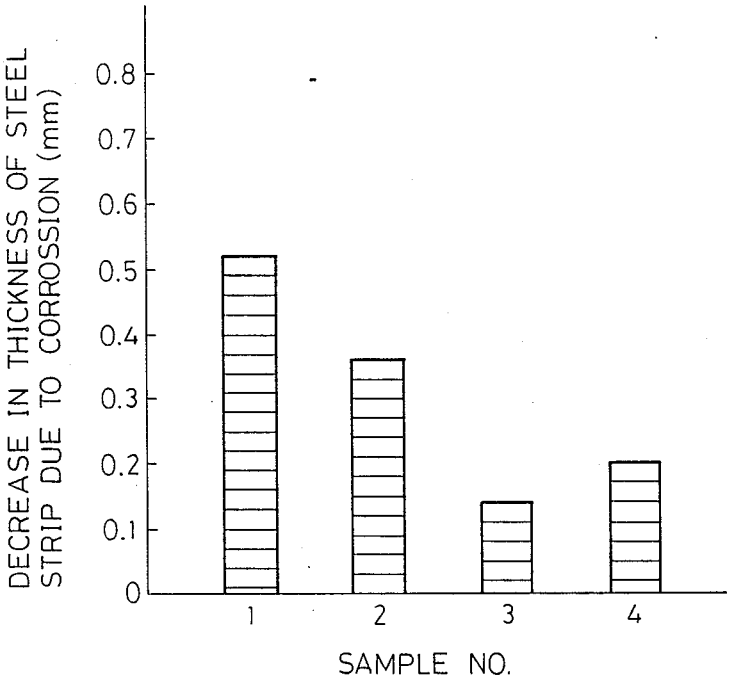
FIG. 1 shows the corrosion resistances of an embodiment of the high corrosion resistant plated composite steel strip of the present invention, two comparative conventional plated composite steel strips, and a comparative conventional zinc-galvanized steel strip.

In the high corrosion resistant plated composite steel strip of the present invention, at least one surface of a steel strip substrate is coated with a corrosion resistant coating layer comprising at least a base electroplating layer.

The base electroplating layer comprises a plating matrix consisting of zinc or a zinc alloy and a number of corrosion-preventing fine solid particles evenly dispersed in the matrix. The corrosion-preventing fine particles consist essentially of fine core solid particles encapsulated by very thin organic or inorganic membranes and are in the form of microcapsules.

In the plated composite steel strip of the present invention, preferably the base plating layer is formed on the steel strip substrate surface in a total amount of from 5 to 50 $g/m^2$, more preferably from 10 to 40 $g/m^2$.

In the base electroplating layer of the present invention, the matrix thereof consists of zinc or a zinc alloy. The zinc alloy consists of zinc and at least one additional metal member to be alloyed with zinc. The additional metal member is preferably selected from the group consisting of Fe, Co, Mn, Cr, Sn, Sb, Pb, Ni, and Mo. The content of the additional metal member in the zinc alloy is not limited to a specific level.

The base plating layer optionally contains a number of additional fine or colloidal particles comprising at least one member selected from the group consisting of $SiO_2$, $TiO_2$, $Cr_2O_3$, $Al_2O_3$, $ZrO_2$, $SnO_2$ and $Sb_2O_5$.

The corrosion-preventing fine solid particles in the form of microcapsules consist essentially of fine core solid particles, for example, particles of water-soluble or slightly water-soluable chromates; aluminum compounds, phosphates, molybdenum compounds, and titanium compounds, and very thin organic or inorganic coating membranes formed around the core particles.

The water-soluble chromates include, for example, $CrO_3$, $Na_2CrO_4$, $K_2CrO_4$, and $K_2O.4ZnO.4CrO_3$. The slightly water-soluble chromates include, for example, $PbCrO_4$, $BaCrO_4$, $SrCrO_4$ and $ZnCrO_4$. The aluminum compounds include, for example, Zn-Al alloys and $Al_2O_3.2SiO_2.2H_2O$. The phosphates include, for example, $Zn_3(PO_4)_2.2H_2O$. The molybdenum compounds include, for example, $ZnO.ZnMoO_4$, $CaMoO_4.ZnOMoO_4$ and $PbCrO_4.PbMoO_4.PbSO_4$. The titanium compounds include, for example, $TiO_2.NiO.Sb_2O_3$.

The core fine particles may consist of an organic substance, for example, fluorine-containing polymer resins or polypropylene resins.

The very thin coating membrane formed around the core particle preferably has a thickness of 1.0 μm or less and comprises at least one member selected from inorganic materials, for example, $SiO_2$, $TiO_2$, $Al_2O_3$ and $ZrO_2$ and organic materials, for example, ethyl cellulose, amino resins, polyvinylidene chloride resins, polyethylene resins, and polystyrene resins.

The corrosion-preventing fine solid particles in the form of microcapsules have the following effects and advantages.

(1) The conventional corrosion-resistant fine particles, for example, chromate and phosphate particles, exhibit a surface potential of substantially zero or a very small value in an electroplating liquid. Accordingly, in the electroplating process in which an electrophoretic property of particles is utilized, the co-deposition property of the conventional corrosion-resistant fine particles is unsatisfactory. The $SiO_2$, $TiO_2$, $Al_2O_3$, or $ZrO_2$ exhibit a satisfactory surface potential in the electroplating liquid, even when in the form of a very thin membrane. Therefore, the fine solid particle of the present invention consisting essentially of a core solid particle consisting of a corrosion-resistant but non-electrophoretic material, for example, chromate, phosphate, aluminum compound, molybdenum compounds or titanium compound and a very thin membrane consisting of an electrophoretic material, for example, $SiO_2$, $TiO_2$, $Al_2O_3$, $ZrO_2$, exhibit a satisfactory electrophoretic and co-deposition property.

(2) The corrosion-preventing core particles, for example, a chromate or phosphate have a relatively high solubility in the electroplating liquid and the thin coating membranes have substantially no or a very low solubility in the electroplating liquid.

For example, a slightly water-soluable chromate particle is dissolved in a small amount in the electroplating liquid and generates $Cr^{6+}$ ions. When the concentration of $Cr^{6+}$ ions in the electroplating liquid reaches a predetermined level or more, it causes the amount of the deposited particles to be decreased, and the resultant plating layer on a substrate exhibits an undesirable black powder-like appearance and a low adhesion to the substrate.

Accordingly, when the corrosion resistant core particles are coated with the insoluble thin membranes, the resultant microcapsulated particles exhibit a satisfactory resistance to dissolution in the electroplating liquid, and the electroplating liquid is maintained in a satisfactory stable condition over a long period and produces a plated composite steel strip having a high quality.

(3) The microcapsulated particles of the present invention dispersed in the base plating layer enhance the corrosion resistance of the plated composite steel strip over the conventional plated composite steel strip containing non-microcapsulated corrosion-resistant particles. This is because the corrosion-preventing activity of the core particles is promoted by the thin coating membranes, for example, $SiO_2$, $TiO_2$, $Al_2O_3$ or $ZrO_2$ membranes, which have a high corrosion-resistance.

Referring to FIG. 1 which shows decreases in thickness of four different plated composite steel strips by a corrosion test, sample No. 1 is a plated composite steel strip which was produced in accordance with the method disclosed in Japanese Unexamined Patent Publication (Kokai) No. 60-96,786 and had 23 g/m$^2$ of an electroplating layer consisting of a zinc matrix and 0.3% by weight of $BaCrO_4$ particles dispersed in the matrix.

Sample No. 2 is a plated composite steel strip which was produced in accordance with the method disclosed in Japanese Unexamined Patent Publication (Kokai) No. 60-211,095 and had 20 g/m$^2$ of an electroplating layer consisting of a matrix consisting of zinc-nickel alloy containing 1% by weight of Ni and particles consisting of 1% by weight of metallic chromium (Cr) and chromium oxide particles and 1% by weight of $Al_2O_3$ particles dispersed in the matrix.

Sample No. 3 is a plated composite steel strip of the present invention having 21 g/m$^2$ of an electroplating layer consisting of a matrix consisting of a zinc-cobalt alloy containing 10% by weight of Co and 4.0% by weight of corrosion-preventing fine solid particles consisting of $BaCrO_4$ core particles and $SiO_2$ coating membranes and 1% by weight additional $TiO_2$ particles.

Sample No. 4 is a zinc-galvanized steel strip which has 90 g/m$^2$ of a thick zinc-galvanizing layer and is believed to exhibit a high perforation resistance over a long period of 10 years or more.

The corrosion test was carried out in such a manner that a corrosion treatment cycle comprising the successive steps of a salt water-spraying procedure at a temperature of 35° C. for 6 hours, a drying procedure at a temperature of 70° C. at a relative humidity of 60%RH for 4 hours, a wetting procedure at a temperature of 49° C. at a relative humidity of more than 95%RH for 4 hours, and a freezing procedure at a temperature of −20° C. for 4 hours, was repeatedly applied 50 times to each sample.

In FIG. 1, the perforation resistances of Sample No. 1, the plated zinc layer of which contained $BaCrO_4$ particles, and Sample No. 2, the plated zinc-nickel alloy layer of which contained metallic chromium and chromium oxide particles and $Al_2O_3$ particles, are poorer than that of Sample No. 4 having a thick (90 g/m$^2$) galvanized zinc layer. Also, FIG. 1 shows that the perforation resistance of Sample No. 1, the plated zinc layer of which contains only a substantially water-insoluble chromate ($BaCrO_4$) particles in a small amount of 0.3% by weight, is unsatisfactory. That is, by the method of Japanese Unexamined Patent Publication (Kokai) No. 60-96786, it is difficult to deposit a large amount of the rust-resistant pigment consisting of substantially water-insoluble chromate particles from the electroplating liquid into the zinc plating layer, because the chromate particles in the plating liquid have a surface potential of approximately zero.

Further, FIG. 1 shows that Sample No. 3, i.e., the plated composite steel strip of the present invention, exhibited a higher perforation resistance than that of Sample No. 4.

Namely, in the plated composite steel strip of the present invention, the microcapsule-like corrosion-preventing fine particles promote the perforation resistance-enhancing effect of the substantially water-insoluble chromate particles in the base electroplating layer.

The conventional corrosion resistant particles dispersed in the base plating layer promote the corrosion resistance of the plating layer in the following manner. For example, when slightly water-soluble chromate particles are co-deposited together with a matrix-forming metal on a steel strip substrate to form a plating layer, and the resultant plated composite steel strip is placed in a corrosive environment, the chromate particles are decomposed with the development of the corrosion and generate $Cr^{6+}$ ions. The $Cr^{6+}$ ions react with the metal in the plating layer to form corrosion resistant chromium compounds and chromium oxides and chromium hydroxide. This phenomenon is effective for providing a corrosion resistant layer in the plating layer and for enhancing the corrosion resistance of the plating layer.

When the chromium compound layer in the plating layer is decomposed, a new corrosion resistant chromium compound layer is formed in the plating layer, because a number of chromate particles are evenly distributed in the plating layer.

The re-formation of the corrosion-resistant chromium compound layer is repeated.

When the microcapsule-like particles of the present invention are used, the corrosion resistant plating layer exhibits a promoted corrosion resistance by the following mechanism.

For example, microcapsule-like particles of the present invention comprising core particles consisting of slightly water-soluble chromate and thin coating membranes consisting of $SiO_2$, a portion of the chromate is very slowly dissolved through the thin coating membranes, because practically, the thin coating membranes do not completely seal the core particles. The generating rate of $Cr^{6+}$ ions in the plating layer of the present invention is significantly smaller than that of the conventional plating layer in which the chromate particles are not encapsulated, and thus the corrosion resistance of the plating layer can be maintained at a satisfactory level over a longer period than the conventional plating layer.

According to the inventors' study, the $Cr^{6+}$ ion-forming rate in the plating layer of the present invention is about $\frac{1}{3}$ to 1/10 that in the conventional plating layer.

That is, the plated composite steel strip of the present invention has a long term corrosion resistance and can withstand a corrosion test over a period of 1 to 3 months, and can meet the demand of a 10 year resistance to perforation for car bodies.

The other types of core particles, for example, phosphate particles which generate $PO_4^{3-}$ ions and molybdenum compound particles which generate $MoO_4^{2-}$ ions, can exhibit the corrosion-preventing effect by the same mechanism as that of the chromate particles.

In the present invention, the corrosion resistant fine particles in the form of microcapsules are preferably contained in a total amount of 0.1% to 30%, more preferably 0.1% to 20% by weight, based on the weight of the base coating layer.

When the content of the corrosion-preventing fine particles is less than 0.1%, the resultant base plating layer sometimes exhibits an unsatisfactory corrosion resistance.

When the content of the corrosion-preventing fine particles is more than 30% by weight, the resultant base plating layer sometimes exhibits an unsatisfactory bonding property to the steel strip substrate.

The additional fine or colloidal particles to be dispersed together with the corrosion-preventing fine particles in the form of microcapsules, for example, $SiO_2$, $TiO_2$, $Cr_2O_3$, $Al_2O_3$, $ZrO_2$, $SnO_2$, and $Sb_2O_5$, promote the corrosion resistance of the base plating layer as follows.

The additional fine or colloidal particles exhibit a lower corrosion-resistant property than that of the corrosion-preventing fine particles, but in the base plating layer, the additional fine or colloidal particles are distributed, between the corrosion-preventing fine particles, and thus can restrict the corrosion of the portion of the base plating layer around the additional particles. Namely, the additional particles exhibit a barrier effect against corrosive action.

In the base plating layer of the present invention, the additional fine or colloidal particles are preferably present in a content of from 0.1% to 30%, more preferably from 0.1% to 20%, based on the total weight of the base electroplating layer.

When the content of additional particles is less than 0.1% by weight, the improvement in the corrosion resistance of the base plating layer due to the additional particles is sometimes unsatisfactory. When the content of the additional particles is more than 30% by weight, the resultant base plating layer sometimes exhibits a poor bonding property to the steel strip substrate.

Preferably, in general the total content of the corrosion-preventing fine particles and the additional particles does not exceed 30% based on the weight of the base plating layer.

In an embodiment of the composite steel strip of the present invention, the corrosion resistant coating layer has an additional thin electroplating layer formed on the base plating layer. The additional electroplating layer preferably comprises at least one member selected from the group consisting of Zn, Fe, Co, Ni, Mn and Cr, and preferably is present in an amount of 1 to 5 $g/m^2$.

In another embodiment of the composite steel strip of the present invention, the corrosion resistant coating layer has a surface coating layer formed on the base plating layer. The surface coating layer may have a single layer structure comprising a member selected from organic resinous materials and mixtures of at least one of the organic resinous materials and chromium ions.

The organic resinous materials include, for example, epoxy resins, epoxy-phenol resins and water-soluble type and emulsion type acrylic resins.

Alternatively, the surface coating layer has a double layer structure consisting essentially of an under layer formed by applying a chromate treatment to the base plating layer surface and an upper layer formed on the under layer and comprising an organic resinous material as mentioned above.

In still another embodiment of the composite steel strip of the present invention, the above-mentioned surface coating layer is formed on the above-mentioned additional thin electroplating layer on the base plating layer.

The additional electroplating layer and the surface coating layer will be explained in detail hereinafter.

In the method of the present invention, at least one surface of a substrate consisting of a descaled steel strip is coated by at least first electroplating the substrate surface in a first electroplating liquid.

The surface of the steel strip to be first electroplated is cleaned by an ordinary surface-cleaning treatment, before the first electroplating step.

The first electroplating liquid contains (a) matrix-forming metal ions selected from zinc ions or a mixture of zinc ions and at least one other metal ion than zinc ions to be alloyed with zinc, (b) a number of the above-mentioned corrosion-preventing fine solid particles in the form of microcapsules, dispersed in the first electroplating liquid and (c) a co-deposition-promoting agent for promoting the co-deposition of the corrosion-preventing particles together with the matrix-forming metal, to provide a base electroplating layer on the substrate surface.

The first electroplating liquid optionally contains at least one type of additional fine or colloidal particles consisting of a member selected from the group consisting of $SiO_2$, $TiO_2$, $Cr_2O_3$, $Al_2O_3$, $ZrO_2$, $SnO_2$, and $Sb_2O_5$.

The co-deposition-promoting agent is used to promote the co-deposition of the corrosion-preventing particles, and optionally the additional particles, together with the matrix-forming metal, from the first electroplating liquid into the base electroplating layer. The co-deposition-promoting agent preferably comprises at least one member selected from the group consisting of $Ni^{2+}$ ions, $Fe^{2+}$ ions, $Co^{2+}$ ions, $Cr^{3+}$ ions, $TiO_2$ colloid, $Al_2O_3$ colloid, $SiO_2$ colloid, $ZrO_2$ colloid, $SnO_2$ colloid, and $Sb_2O_5$ colloid.

The role of the above-mentioned ions or colloids as the co-deposition-promoting agent will be explained below.

As stated above, the surface potential of the corrosion-preventing particles in the electroplating liquid can be controlled by the thin coating membranes. When the corrosion-preventing particles have thin $SiO_2$ coating membranes, the resultant microcapsule-like particles have a negative surface potential.

In an electroplating process in which a steel strip serves as a cathode, it is difficult to deposit the microcapsules-like particles having the thin $SiO_2$ coating membranes into the plating layer on the steel strip substrate. Accordingly, the deposition of the microcapsules-like particles into the plating layer must be promoted by using the co-deposition-promoting agent.

Where $Ni^{2+}$ ions are used as the co-deposition-promoting agent, the $Ni^{2+}$ ions are absorbed on the surface of the $SiO_2$ coating membrane surfaces of the microcapsule-like particles so that the surfaces of the microcapsule-like particles have a positive potential. The microcapsule-like particles having the positive surface potential can be readily drawn to and deposited into the plating layer on the cathode (steel strip).

The $Co^{2+}$, $Fe^{2+}$ and $Cr^{3+}$ ions in the electroplating layer exhibit the same co-deposition-promoting effect as that of the $Ni^{2+}$ ions. The metal ions $Ni^{2+}$, $Co^{2+}$, $Fe^{2+}$ and $Cr^{3+}$, are also deposited to form a zinc alloy matrix which is effective for enhancing the corrosion resistance of the first electroplating layer.

The $SiO_2$, $TiO_2$, $Al_2O_3$, $ZrO_2$, $SnO_2$ and $Sb_2O_5$ colloids added to the electroplating liquid serve as a co-deposition-promoting agent in the same manner as that of the $Ni^{2+}$ ions, etc.

When added to the electroplating liquid, the colloid particles exhibit a positive or negative potential and are absorbed on the surfaces of the corrosion-preventing microcapsule-like fine particles. For example, at a pH of 1 to 2.5, $Al_2O_3$, $ZrO_2$, $SnO_2$, and $TiO_2$ colloid particles exhibit a positive potential, and $SiO_2$ and $Sb_2O_5$ colloid particles exhibit a negative potential. Accordingly, the nature and intensity of the potential of the fine particles in the electroplating liquid can be adjusted to a desired level by controlling the type and amount of the colloid particles to be added to the electroplating liquid, in consideration of the type of the electroplating method.

That is, the composition of the co-deposition-promoting agent should be determined in view of the composition of the corrosion-preventing microcapsule-like particles, especially the type and nature of the thin coating membrane.

The co-deposition of the corrosion-preventing particles can be promoted by using another type of co-deposition-promoting agent which is very effective for the accelerated co-deposition of the corrosion-preventing particles and for stabilizing the electroplating step for the base plating layer.

The co-deposition-promoting agent comprises at least one member selected from the group consisting of amine compounds having a cationic polar structure of the formula (1):

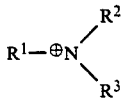

(1)

ammonium compounds having a cationic polar structure of the formula (2):

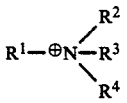

(2)

wherein $R^1$, $R^2$, $R^3$, and $R^4$ represent, respectively and independently from each other, a member selected from the group consisting of a hydrogen atom, and alkyl and aryl radicals, and polymers having at least one type of the cationic polar radical.

The amine compounds, ammonium compounds and the cationic polymers are selected, for example, from ethylene imine

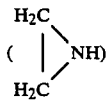

and ethylene imine-containing polymers, diallylamine

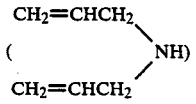

diallylamine-containing polymers, polyaminesulfones which are copolymers of diallylamine and $SO_2$, trimethylammonium chlorides

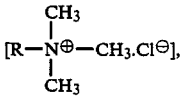

diallyldimethylammonium chloride

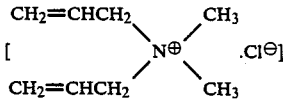

and alkyl betaines

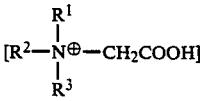

The base plating layer of the present invention has a satisfactory rust-resistance and corrosional perforation resistance, but it was found that, when some types of the plated composite steel strips are subjected to a chemical conversion treatment as a treatment prior to a paint coating step, the base plating layer tends to hinder the growth of chemical conversion membrane crystals.

That is, the chemical conversion membranes are formed only locally and the crystals in the membrane are coarse, and therefore, the chemical conversion membrane exhibits a poor adhesion to the paint coating. This disadvantage is serious when the base plating layer contains chromium-containing particles.

Accordingly, where a paint coating is required, for example, on a steel strip to be used for forming outer surfaces of the car bodies, preferably the base electroplating layer is coated with a thin additional electroplating layer, preferably in a weight of 1 to 5 g/m$^2$. The additional electroplating layer preferably comprises at least one type of metal selected from the group consisting of Zn, Fe, Co, Ni, Mn, and Cr.

The base plating layer in the plated composite steel strip of the present invention may be coated with a surface coating layer having a coating structure selected from the group consisting of simple coating layers comprising an organic resinous material, and optionally, chromium ions evenly mixed in the paint, and composite coating layers each consisting of an under layer formed by applying a chromate treatment to the base electroplating layer surface and an upper layer formed on the under layer and comprising an organic resinous material. The surface coating layer effectively enhances the firm adhesion of the paint to the plated composite steel strip.

The above-mentioned surface coating layer may be further formed on the additional electroplating layer formed on the base electroplating layer.

In the method disclosed in Japanese Unexamined Patent Publication (Kokai) No. 60-96786, the first electroplating operation is carried out with a first electroplating liquid having a pH of 3.5 or more. Where the steel strip serves as a cathode and the electroplating liquid has a pH of 3.5 or more, the pH at the interface between the cathode and the electroplating liquid is easily increased to a level of pH at which a membrane of $Zn(OH_2)$ is formed. The $Zn(OH)_2$membrane hinders the deposition of metal ions and the rust-resistant pigment particles having a larger size than that of the metal ions onto the cathode surface through the $Zn(OH)_2$ membrane. That is, the formation of the electrocoating layer containing the corrosion-resistant dispersoid particles is obstructed by the $Zn(OH)_2$ membrane formed on the cathode surface. Therefore, the resultant plating layer has an unstable composition, contains a very small amount of the corrosion resistant dispersoid particles, and thus exhibits an unsatisfactory corrosion resistance.

Figure 2:
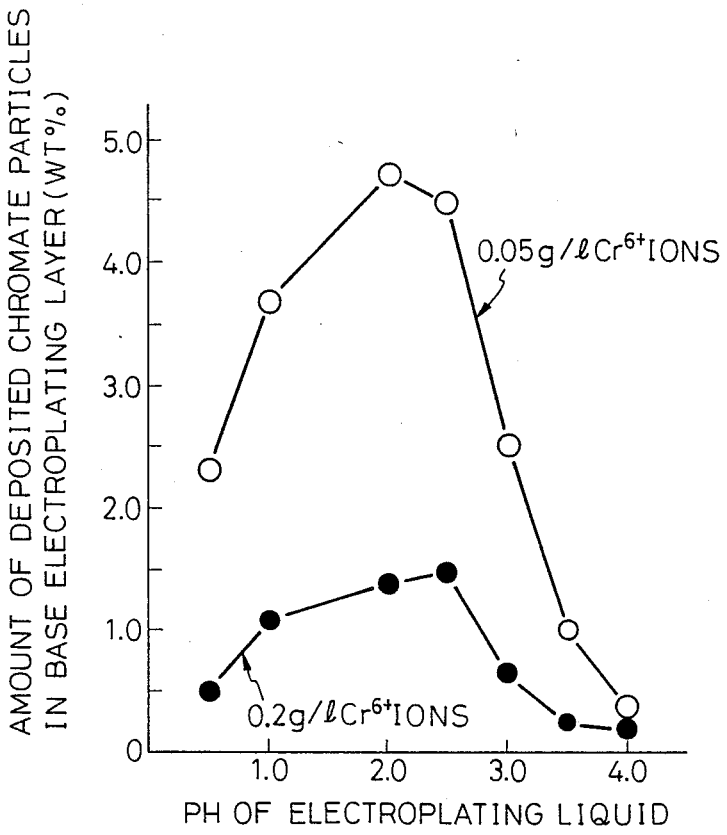
FIG. 2 shows the relationship between the pH of the plating liquids and the amounts of substantially water-insoluble chromate particles deposited from the plating liquids.

Referring to FIG. 2, which shows a relationship between the pH of the electroplating liquid and the amount of slightly water-soluble chromate fine particles deposited from the electroplating liquid, it is clear that, at a pH of 3.5 or more, the amount of the deposited chromate fine particles becomes very small.

Also, it should be noted that a portion of the chromate particles is dissolved in the electroplating liquid to generate $Cr^{6+}$ ions. If the electroplating operation is carried out in an electroplating liquid containing a large amount of $Cr^{6+}$ ions, the resultant electroplating layer is formed by a black colored powder and exhibits a very poor adhesion to the steel strip substrate. Where the content of $Cr^{6+}$ ions in the electroplating liquid is in the range of from 0.1 to 0.25 g/l, the black colored deposit is not formed in the resultant electroplating layer. However, the electroplating layer contains a very small amount of the slightly water-soluble chromate fine particles deposited therein.

FIG. 2 suggests that, in the range of a $Cr^{6+}$ ion content of from 0.1 to 0.25 g/l in the electroplating liquid, an increase in the content of $Cr^{6+}$ ions results in remarkable decrease in the amount of the slightly water-soluble chromate fine particles deposited.

Figure 3:
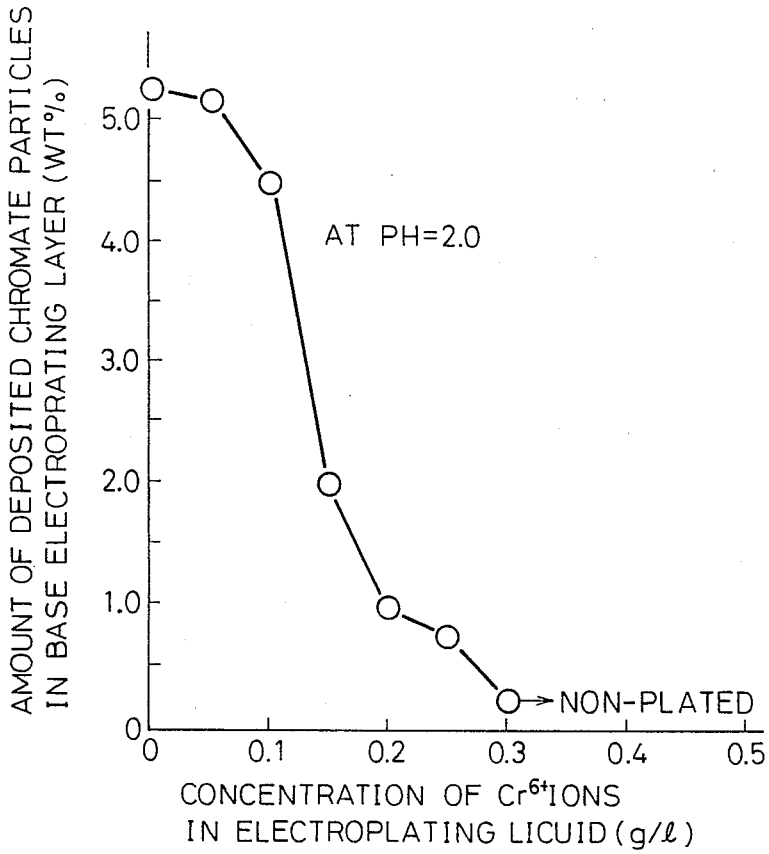
FIG. 3 shows a relationship between a concentration of $Cr^{6+}$ ions in a plating liquid and an amount of substantially water-insoluble chromate particles deposited from the plating liquid.

Also, referring to FIG. 3 showing a relationship between the content of $Cr^{6+}$ ions in an electroplating liquid and the amount of slightly water-soluble chromate fine particles deposited from the electroplating liquid, it is clear that the increase in the content of $Cr^{6+}$ results in a remarkable decrease in the amount of the deposited chromate fine particles, and at a $Cr^{6+}$ ion content of 0.3 g/l or more, practical electroplating becomes impossible.

In the method of Japanese Unexamined Patent Publication (Kokai) No. 60-96786, an attempt is made to resolve the $Cr^{6+}$ ion problem in the following manner.

That is, where an electroplating liquid contains $BaCrO_4$ fine particles as substantially water-insoluble chromate fine particles, a portion of the $BaCrO_4$ is dissolved in the electroplating liquid and is dissociated by the following reaction.

$$BaCrO_4 \rightleftharpoons Ba^{2+} + CrO_4^{2-}(Cr^{6+})$$

The reaction in the → direction causes the $BaCrO_4$ to be dissolved in the electroplating liquid. To restrict the dissolution reaction, the ionic dissociation of the $BrCrO_4$ should be prevented by, for example, adding $Ba^{2+}$ ions. The addition of $Cr^{6+}$ ions should be avoided, because the increase in the $Cr^{6+}$ ion content in the electroplating liquid results in a decrease in the plating utility of the electroplating liquid.

To add $Ba^{2+}$ ions, $BaCl_2$, which has a relatively large solubility in water, is preferably added to the electroplating liquid. In the method of Japanese Unexamined Patent Publication No. 60-96786, the electroplating liquid contains chlorides including $BaCl_2$. However, when a non-soluble electrode is used as an anode in a chloride-containing electroplating liquid, chlorine gas is generated from the electroplating liquid. Therefore, a soluble electrode must be used as an anode in the chloride-containing electroplating liquid.

However, in most of the recent electroplating apparatuses, the electrode is a fixed type, and thus is a non-soluble electrode, because generally, in most recent electroplating methods, a horizontal, high flow speed type electroplating cell is used, the distance between the steel strip and electrode is made short to increase the current density to be applied to the electroplating process, and the plated steel strip is produced at a very high efficiency which corresponds to several times that obtained in a conventional electroplating process.

The method of the present invention is very useful for electroplating a steel strip substrate in a horizontal, high flow speed type electroplating apparatus at a high current density and at a high efficiency. In this type of electroplating process, when a non-soluble electrode is used, the electroplating liquid is preferably a sulfate type plating bath.

In the sulfate type plating bath, the generation of $Cr^{6+}$ ions cannot be prevented by adding $Ba^{2+}$ ions to the bath, because the added $Ba^{2+}$ ions are converted to $BaSO_4$ which is insoluble in water and deposits from the bath.

Accordingly, where the sulfate type plating liquid is used as a first electroplating bath for the method of the present invention, it is preferable to convert the dissolved $Cr^{6+}$ ions to $Cr^{3+}$ ions by adding grains or a plate of a metal, for example, metallic zinc or iron, or a reducing agent, for example, sodium sulfite, in a necessary amount for reducing the dissolved $Cr^{6+}$ ions to $Cr^{3+}$ in the first electroplating liquid. In this manner, an oxidation-reduction reaction is utilized.

Figure 4:
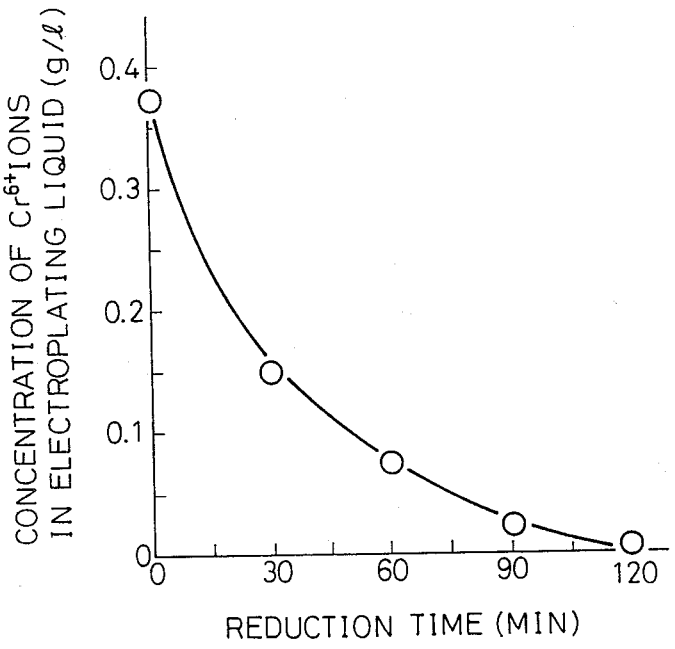
FIG. 4 shows a relationship between an oxidation-reduction reaction time of metallic zinc grains with $Cr^{6+}$ ions in a plating liquid and a concentration of $Cr^{6+}$ ions in the plating liquid; and, FIGS. 5A, 5B, 5C, and 5D, respectively, are explanatory cross-sectional views of an embodiment of the plated composite steel strip of the present invention.

FIG. 4 shows a relationship between the reaction time (minute) of metallic zinc grains added in an amount of 20 kg/m$^3$ in an electroplating liquid and the concentration (g/l) of $Cr^{6+}$ ions dissolved in the electroplating liquid. In view of FIG. 4, it is clear that, after the metallic zinc grains are added to the electroplating liquid, the $Cr^{6+}$ ions are reduced to $Cr^{3+}$ ions by the reduction reaction of the zinc grains, and thus the concentration of the $Cr^{6+}$ ions decreases with the lapse of the reaction time.

That is, it was found that a high corrosion resistant plated composite steel strip, in which a stable dispersion of the corrosion-resistant solid particles in a satisfactory amount in a base plating layer is ensured, can be easily produced by the method of the present invention in which, preferably, the pH of the first electroplating liquid is controlled to a level of 3.5 or less, more preferably from 1 to 2.5, and the concentration of the dissolved $Cr^{6+}$ ions is restricted to a level of 0.1 g/l or less, more preferably 0.05 g/l or less, by adding metal grains or plate or a reducing agent to the first electroplating liquid, at a wide range of current density from a low level to a high level.

The resultant high corrosion resistant plated composite steel strip of the present invention exhibits an excellent metal plating and adhesion, weldability, and painting properties.

Figure 5A:
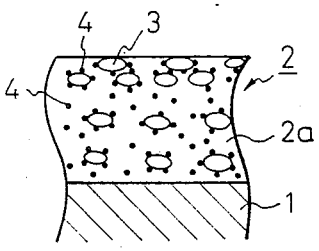

Referring to FIG. 5A, a plated composite steel plate is composed of a steel strip substrate 1 descaled by a ordinary surface cleaning treatment and a base plating layer 2, which consists of a metal matrix 2*a* consisting of zinc or a plurality or a zinc alloy, for example, an alloy of zinc with at least one member selected from Fe, Co, Mn, Cr, Sn, Sb, Pb, Ni and Mo, and a number of corrosion-preventing microcapsule-like fine particles 3 of the present invention and additional fine or colloidal particles 4 consisting of a member selected from $SiO_2$, $TiO_2$, $Cr_2O_3$, $Al_2O_3$, $ZrO_2$, $SnO_2$ and $Sb_2O_5$.

Figure 5B:
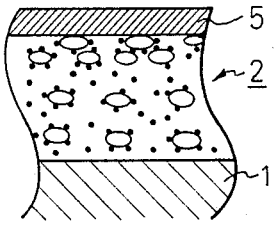
Figure 5C:
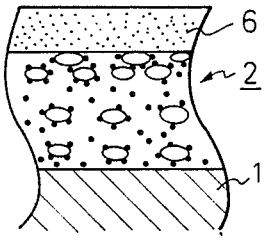

Referring to FIG. 5B, a base plating layer 2 formed on a steel strip substrate 1 is coated by a thin additional electroplating layer 5, which comprises at least one member selected from Zn, Fe, Co, Ni, Mn and Cr. Preferably, the additional electroplating layer 5 is present in an amount of 1 to 5 g/m$^2$. In FIG. 5C, a base electroplating layer 2 is coated with a coating layer 6. The coating layer 6 may be a single coated layer structure made of an organic resinous material, which optionally contains chromium ions evenly mixed in the resinous material, or a double coating layer structure consisting of an under layer formed by applying a chromate treatment to the base plating layer surface and an upper layer formed on the under layer and comprising an organic resinous material as mentioned above.

Figure 5D:
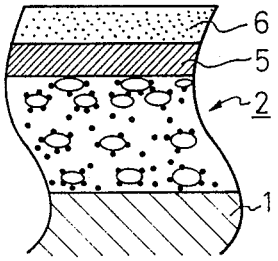

As shown in FIG. 5D, the same coating layer 6 as mentioned above is formed on the additional electroplating layer 5 formed on the base electroplating layer 2.

The coating layer 6 is preferably formed when the base or additional electroplating layer contains chromium. When a chromium-containing compound, for example, the slightly water-soluble chromate, or metallic chromium is contained in an electroplating layer, and a chemical conversion treatment is applied as a pre-paint coating step to the surface of the electroplating layer, it is known that the resultant chemical conversion membrane contains coarse crytals. The coarse crystals cause the chemical conversion membrane to exhibit a poor paint coating property. Therefore, preferably a surface layer to be chemical conversion-treated is free from chromium compound or metallic chromium.

The organic resinous material usable for the surface coating layer may be selected from epoxy resins, epoxy-phenol resins, and water-soluble polyacrylic resin emulsion type resins.

The organic resinous material may be coated by any conventional coating method, for example a roll-coating method, electrostatic spraying method, and curtain flow method. From the aspect of ensuring the weldability and processability of the resultant plated composite steel strip, the thickness of the organic resinous material layer is preferably 2 μm or less.

In the surface coating layer, the organic resinous material layer is also effective for preventing the undesirable dissolution of chromium from the chromate-treated under layer, which is very effective for enhancing the corrosion resistance of the plated composite steel strip. The dissolution of chromium sometimes occurs when the plated composite steel strip having the chromate treatment layer is subjected to a degreasing procedure or chemical conversion procedure, and can be prevented by coating the chromium compound-containing layer with the resinous material layer, which optionally contains chromium ions.

Recently, a method of applying a new surface coating layer having a thickness of about 2 μm and containing $SiO_2$ particles etc, to the electroplating layer has been developed. This surface coating layer consisting of an organic resinous material and the $SiO_2$ particles can exhibit a high corrosion resistance without the chromate treatment or using chromium ions.

The present invention will be further explained by way of specific examples which, however, are representative and do not restrict the scope of the present invention in any way.

Examples 1 to 38 and Comparative Examples 1 to 7

In each of the example and comparative examples, a cold-rolled steel strip having a thickness of 0.8 mm, a length of 200 mm, and a width of 100 mm was degreased with an alkali aqueous solution, pickled with a 10% sulfuric acid aqueous solution, and washed with water.

The descaled steel strip was subjected to a first electroplating procedure wherein the steel strip served as a cathode, a first electroplating liquid containing necessary metal ions, corrosion-preventing fine particles, additional fine or colloidal particles and a co-deposition-promoting agent, as shown in Table 1, was stirred and circulated through an electroplating vessel and a circulating pump, while controlling the amounts of the above-mentioned components to a predetermined level, and while maintaining the pH of the first electroplating liquid at a level of 2, and the electroplating operation was carried out at a temperature of about 50° C. at a current density of 40 A/dm$^2$ for about 22 seconds to provide base electroplating layers in a targeted weight of 22 g/m$^2$ formed on both surfaces of the steel strip.

For example, in each of Examples 22 to 25 in which the resultant base electroplating layer was composed of a matrix consisting of a zinc (90%)-cobalt (10%) alloy and corrosion-preventing fine particles consisting of 4% by weight of $BaCrO_4$ core particles capsulated with a $SiO_2$ membrane and 1% of weight of additional $TiO_2$ colloidal particles, the first electroplating liquid had the following composition.

| | |
|---|---|
| $ZnSO_4.7H_2O$ | 180 g/l |
| $CoSO_4.7H_2O$ | 10 to 450 g/l |
| $BaCrO_4$ core particle encapsulatd by $SiO_2$ membrane | 5 to 60 g/l |
| $TiO_2$ | 0.5 to 60 g/l |

In each of Example 2, 6 to 12, 16 to 19, 23, 27, 28, 30 to 32, 35, 37 and 38, an additional electroplating layer in the total amount of 1 to 5 g/m$^2$ and the composition as shown in Table 1 was formed on the base electroplating layer surface by using a second electroplating liquid containing necessary metal ions, for example, Zn ions or a mixture of Zn ions with Fe, Co, Ni Mn and/or Cr ions in the form of sulfates.

In each of Examples 3, 4, 6, 8, 10, 13 to 15, 20, 21, 24, 25, 28 to 30, 32, and 35 to 38, a surface coating layer having the composition and the thickness as shown in Table 1 was formed on the base electroplating layer or the additional electroplating layer.

In the formation of the surface coating layer, the organic resinous material layer or chromium-containing organic resious material layer was formed by a roll-coating method and by using a water-soluble polyacrylic resin emulsion. Also, the chromate treatment was carried out by coating, reaction or electrolysis.

The resultant plated composite steel strip was subjected to the following tests.

1. Cyclic corrosion resistance test

A painted specimen, which was prepared by a full-dip type chemical conversion treatment and a cationic paint-coating, and an unpainted specimen, were scratched and then subjected to a 50 cycle corrosion test. In each cycle of the corrosion test, the specimens were subjected to salt water-spraying at 35° C. for 6 hours, to drying at 70° C. at 60%RH for 4 hours, to wetting at 49° C. and at a 95%RH or more for 4 hours, and then to freezing at −20° C. for 4 hours.

After the 50 cycle corrosion test, the formation of red rust and the depths of pits formed in the specimens were measured.

2. Paint adhesion property

A specimen was subjected to a full-dip type chemical conversion treatment, was coated three times with paint, and was then immersed in hot water at 40° C. for 10 days.

After the completion of the immersion step, the specimen was subjected to a cross-cut test in which the specimen surface was scratched in a chequered pattern at intervals of 2 mm to form 100 squares. Then an adhesive tape was adhered on the scratched surface of the specimen and was peeled from the specimen. The number of squares separated from the specimen was then counted.

The rust resistance was evaluated as follows.

| Class | Rust formation R (%) |
|---|---|
| 5 | $R = 0$ |
| 4 | $R \leqq 5$ |
| 3 | $5 < R \leqq 20$ |
| 2 | $20 < R \leqq 50$ |
| 1 | $50 < R$ |

The depth of corrosion was evaluated as follows.

| Class | Depth C (mm) of pits |
|---|---|
| 5 | $C = 0$ |
| 4 | $C \leqq 0.1$ |
| 3 | $0.1 < C \leqq 0.3$ |
| 2 | $0.3 < D \leqq 0.5$ |
| 1 | $0.5 < C$ |

The paint-adhesion property was evaluated as follows.

| Class | Peeled squares D (%) |
|---|---|
| 5 | $D = 0$ |
| 4 | $D \leqq 5$ |
| 3 | $5 < D \leqq 20$ |
| 2 | $20 < D \leqq 50$ |
| 1 | $50 < D$ |

The results of the tests are shown in Table 1.

TABLE 1

| Example No. | Coating: Base electroplating layer: Weight ($g/m^2$) | Matrix metal | Corrosive-preventing particle: Core particle | Coating membrane | Additional particle | Additional electroplating layer | Surface coating layer | Corrosion resistance: Unpainted: Red rust formation (%) | Corrosion depth | Painted: corrosion depth | Paint adhesion |
|---|---|---|---|---|---|---|---|---|---|---|---|
| Example | | | | | | | | | | | |
| 1 | 20 | Zn—9% Ni | 3% $BaCrO_4$ | $SiO_2$ | None | None | None | 4 | 4 | 3 | 2 |
| 2 | 20 | Zn—9% Ni | 3% $BaCrO_4$ | $SiO_2$ | None | Zn—11% N:(3 $g/m^2$) | None | 4 | 4 | 4 | 5 |
| 3 | 20 | Zn—9% Ni | 3% $BaCrO_4$ | $SiO_2$ | None | Zn—11% N:(3 $g/m^2$) | Resin (1 μm) | 4 | 4 | 4 | 5 |
| 4 | 20 | Zn—9% Ni | 3% $BaCrO_4$ | $SiO_2$ | None | None | 20 $mg/m^2$ Cr con- | 5 | 5 | 5 | 5 |
| 5 | 21 | Zn—10% Fe | 10% $SrCrO_4$ | $SiO_2 + Al_2O_3$ | 0.5% $Al_2O_3$ 1% $TiO_2$ | None | None | 4 | 3 | 3 | 2 |
| 6 | 21 | Zn—10% Fe | 10% $SrCrO_4$ | $SiO_2 + Al_2O_3$ | 0.5% $Al_2O_3$ 1% $TiO_2$ | Zn—11% N: + Co (0.5 $g/m^2$) | Chromate (Cr: 60 $mg/m^2$) +5 Resin (1.8 μm) | 5 | 5 | 5 | |
| 7 | 21 | Zn—10% Fe | 10% $SrCrO_4$ | $SiO_2 + Al_2O_3$ | 0.5% $Al_2O_3$ 1% $TiO_2$ | Zn—87% Fe (2 $g/m^2$) | None | 3 | 3 | 3 | 5 |
| 8 | 19 | Zn—5% Sn—3% Cr | 20% $ZnCrO_4$ | $ZrO_2$ | 3% $ZrO_2$ | Zn—35% Mn—3% Cr (4 $g/m^2$) | 30 $mg/m^2$ Cr-containing resin (1.5 μm) | 5 | 5 | 5 | 5 |
| 9 | 19 | Zn—5% Sn—3% Cr | 20% $ZnCrO_4$ | $ZrO_2$ | 3% $ZrO_4$ | Zn—30% Cr (2 $g/m^2$) + Zn—10% Co (1 $g/m^2$) | None | 4 | 4 | 4 | 4 |
| 10 | 21 | Zn—4% Co—1% Pb—0.5% Mo | 25% $PbCrO_4$ | $SiO_2 + TiO_2$ | 2% $Al_2O_3$ | Fe—30% Ni (2 $g/m^2$) | 30 $mg/m^2$ Cr-containing resin (1.5 μm) | 5 | 5 | 5 | 5 |
| 11 | 21 | Zn—4% Co—1% Pb—0.5% Mo | 25% $PbCrO_4$ | $SiO_2 + TiO_2$ | 2% $Al_2O_3$ | Ni (1 $g/m^2$) + Fe (0.5 $g/m^2$) + + Zn—10% Ni (1 $g/m^2$) | None | 4 | 4 | 4 | 5 |
| 12 | 19 | Zn—11% Ni | 5% $ZnCrO_4$ | $SiO_2$ $ZrO_2$ | 1% $SiO_2$ | Zn—87% Fe (3.5 $g/m^2$) | None | 3 | 3 | 4 | 5 |
| 13 | 19 | Zn—11% Ni | 5% $ZnCrO_4$ | $SiO_2 + ZrO_2$ | 1% $SiO_2$ | None | 100 $mg/m^2$ Cr-containing resin (1 μm) | 5 | 5 | 5 | 5 |
| 14 | 21 | Zn—30% Fe | 4% $BaCrO_4$ | $SiO_2 + Al_2O_3$ | 1.5% $TiO_2$ | None | Resin (1 μm) | 5 | 5 | 4 | 5 |
| 15 | 21 | Zn—30% Fe | 4% $BaCrO_4$ | $SiO_2 + Al_2O_3$ | 1.5% $TiO_2$ | None | Chromate (Cr: 20 $mg/m^2$) + resin (1.5 μm) | 5 | 5 | 5 | 5 |
| 16 | 21 | Zn—1.5% Co | 11% $SrCrO_4$ | $SiO_2$ | 11% $Al_2O_3$ | Zn (3 $g/m^2$) | None | 4 | 3 | 3 | 4 |
| 17 | 21 | Zn—3% Sn—10% Ni | 12% $BaCrO_4$ | $SiO_2$ | 2% $ZrO_2$ + 1.5% $TiO_2$ | Zn—10% Co (4 $g/m^2$) | None | 4 | 4 | 4 | 5 |
| 18 | 20 | Zn—2% Sb | 2% $BaCrO_4$ | $SiO_2$ | 0.9% $ZnO_2$ + 1.5% $Cr_2O_3$ + 1.5% $TiO_2$ | Zn—30% Mn (2 $g/m^2$) | None | 4 | 4 | 4 | 5 |
| 19 | 20 | Zn—3% Pb—1.5% Co—1.5% Sn | 1% $PbCrO_4$ | $SiO_2$ | 3% $SiO_2$ | Zn—11% Ni (3.5 $g/m^2$) | None | 4 | 4 | 4 | 5 |
| 20 | 20 | Zn—3% Pb—1.5% Co—1.5% Sn | 1% $PbCrO_4$ | $SiO_2$ | 3% $SiO_2$ | Zn—11% Ni (3.5 $g/m^2$) | 60 $mg/m^2$ Cr-containing resin (1.5 μm) | 5 | 5 | 5 | 5 |
| 21 | 20 | Zn—3% Pb—1.5% Co—1.5% Sn | 1% $PbCrO_4$ | $SiO_2$ | 3% $SiO_2$ | Zn—11% Ni (3.5 $g/m^2$) | Resin (1 μm) | 5 | 5 | 5 | 5 |
| 22 | 20 | Zn—10% Co | 4% $BaCrO_4$ | $SiO_2$ | 1% $TiO_2$ | None | None | 4 | 3 | 4 | 3 |
| 23 | 20 | Zn—10% Co | 4% $BaCrO_4$ | $SiO_2$ | 1% $TiO_2$ | Zn—11% Ni (3.5 $g/m^2$) | None | 4 | 4 | 4 | 5 |
| 24 | 20 | Zn—10% Co | 4% $BaCrO_4$ | $SiO_2$ | 1% $TiO_2$ | Zn—11% Ni (3.5 $g/m^2$) | Chromate (Cr: 40 $mg/m^2$) + resin (1 μm) | 5 | 5 | 5 | 5 |
| 25 | 20 | Zn—10% Co | 4% $BaCrO_4$ | $SiO_2$ | 1% $TiO_2$ | None | 60 $mg/m^2$ Cr-containing resin (1.5 μm) | 5 | 5 | 5 | 5 |
| 26 | 20 | Zn—15% Sn | 4% $CrO_3$ | $SiO_2$ | None | None | None | 4 | 4 | 4 | 3 |
| 27 | 20 | Zn—15% Sn | 4% $CrO_3$ | $SiO_2$ | None | Zn—80% Fe (2.5 $g/m^2$) | None | 4 | 4 | 5 | 5 |
| 28 | 21 | Zn—20% Fe | 3% | $ZrO_2$ | 2% $Al_2O_3$ | Co (1 $g/m^2$) | Chromate (Cr: 40 $mg/m^2$) + | 5 | 5 | 5 | 5 |

TABLE 1-continued

| Example No. | Coating: Base electroplating layer: Weight ($g/m^2$) | Matrix metal | Corrosive-preventing particle: Core particle | Corrosive-preventing particle: Coating membrane | Additional particle | Additional electro-plating layer | Surface coating layer | Corrosion resistance: Unpainted: Red rust formation (%) | Unpainted: Corrosion depth | Painted: corro-sion depth | Paint adhe-sion |
|---|---|---|---|---|---|---|---|---|---|---|---|
| 29 | 19 | Zn—11% Ni | $Zn_3(PO_4)_2$ 1.5% $NaCrO_4$ | $SiO_2 + Al_2O_3$ | 1% $SiO_2$ | None | resin (1.5 μm) 30 $mg/m^2$ Cr-containing resin (1 μm) | 5 | 5 | 5 | 5 |
| 30 | 19 | Zn—11% Ni | 1.5% $NaCrO_4$ | $SiO_2 + Al_2O_3$ | 1% $SiO_2$ | Zn—10% Co (4 $g/m^2$) | Resin (1 μm) | 4 | 4 | 5 | 4 |
| 31 | 19 | Zn—11% Ni | 1.5% $NaCrO_4$ | $SiO_2 + Al_2O_3$ | 1% $SiO_2$ | Zn—11% Ni (3.5 $g/m^2$) | None | 4 | 3 | 4 | 4 |
| 32 | 20 | Zn—3% Co | 1% ZnO. $ZnMoO_4$ | $SiO_2$ | 1.5% $ZrO_2$ +Zn (2 $g/m^2$) 1% $TiO_2$ | Chromate (Cr: 20 $mg/m^2$) + | 5 resin (1.2 μm) | 5 | 5 | 5 | |
| 33 | 20 | Zn—3% Co | 1% ZnO. $ZnMoO_4$ | $SiO_2$ | 1.5% $ZrO_2$ +None 1% $TiO_2$ | None | 4 | 4 | 4 | 4 | |
| 34 | 20 | Zn—5% Ni—3% Cr | 2% $SrCrO_4$ + 3% $CrO_3$ | $ZrO_2 + SiO_2$ | 3% $SiO_2$ | None | None | 4 | 3 | 4 | 3 |
| 35 | 20 | Zn—5% Ni—3% Cr | 2% $SrCrO_4$ + 3% $CrO_3$ | $ZrO_2 + SiO_2$ | 3% $SiO_2$ | Zn—30% Mn (2 $g/m^2$) | 60 $mg/m^2$ Cr-containing resin (1.2 μm) | 5 | 5 | 5 | 5 |
| 36 | 20 | Zn—5% Ni—3% Cr | 2% $SrCrO_4$ + 3% $CrO_3$ | $ZrO_2 + SiO_2$ | 3% $SiO_2$ | None | 60 $mg/m^2$ Cr-containing resin (1.2 μm) | 4 | 4 | 4 | 5 |
| 37 | 20 | Zn—3% Sb | 3% $Al_2O_3$. $2SiO_2$ | $SiO_2$ | 1.5% $TiO_2$ | Fe—30% Ni (2.5 $g/m^2$) | Resin (1.4 μm) | 4 | 4 | 5 | 5 |
| 38 | 20 | Zn—3% Sb | 3% $Al_2O_3$. $2SiO_2$ | $SiO_2$ | 1.5% $TiO_2$ | Ni (2 $g/m^2$) | Resin (1.4 μm) | 4 | 4 | 5 | |
| Comparative Example | | | | | | | | | | | |
| 1 | 23 | Zn—12% Ni | None | None | None | None | None | 1 | 1 | 3 | 5 |
| 2 | 23 | Zn | 0.05% $BaCrO_4$ | None | None | None | None | 1 | 1 | 2 | 3 |
| 3 | 23 | Zn | 0.3% $BaCrO_4$ | None | None | None | None | 2 | 1 | 2 | 2 |
| 4 | 20 | Zn—1% Ni—1% Cr | None | None | 1% $Al_2O_3$ | None | None | 2 | 2 | 3 | 3 |
| 5 | 20 | Zn—10% Ni—0.5% Cr | None | None | 3% $SiO_2$ | None | None | 3 | 2 | 3 | 3 |
| 6 | 22 | Zn—9% Ni | 1% $BaCrO_4$ | None | None | None | None | 2 | 2 | 2 | 2 |
| 7 | 22 | Zn—13% Ni | 2.5% $BaCrO_4$ | None | None | None | None | 3 | 2 | 3 | 1 |

Note:
In the column of additional particle, "+" means a mixture of two or more different types of additional particles. In the columns of the additional electroplating layer and the surface coating layer, "+" means a lamination of two or more different component layers.

Table 1 clearly shows that the plated composite steel strips of Examples 1 to 38 in accordance with the present invention exhibited an enhanced corrosion resistance and a satisfactory paint-adhesion in comparison with the comparative plated composite steel strip. Namely, the specific corrosion-preventing fine particles in the form of microcapsules are effective for promoting the corrosion resistance of the resultant plated composite steel strip.

We claim:

1. A high corrosion resistant electroplated composite steel strip comprising:

(A) a substrate consisting essentially of a steel strip; and (B) at least one corrosion resistant coating layer formed on at least one surface of the steel strip substrate and comprising at least a base plating layer which comprises (a) a matrix consisting of a member selected from the group consisting of zinc and zinc alloys, and (b) a number of corrosion-preventing fine solid particles in the form of microcapsules dispersed in the matrix and consisting essentially of (i) fine core solid particles comprising at least one member selected from the group consisting of chromates, aluminum compounds, phosphates, molybdenum compounds and titanium compounds; and (ii) very thin membranes encapsulating the fine core solid particles therein and comprising at least one member selected from the group consisting of $SiO_2$, $TiO_2$, $Al_2O_3$, $ZrO_2$, ethyl cellulose, amino resins, polyvinylidene chloride resins, polyethylene resins and polystyrene resins.

2. The composite steel strip as claimed in claim 1, wherein the membranes have a thickness of 1.0 $\mu$m or less.

3. The composite steel strip as claimed in claim 1, wherein the base plating layer is present in an amount of 5 to 50 g/m$^2$.

4. The composite steel strip as claimed in claim 1, wherein the corrosion-preventing particles are present in a total amount of 0.1% to 30% by weight based on the weight of the base plating layer.

5. The composite steel strip as claimed in claim 1, wherein the corrosion resistant coating layer has a surface coating layer formed on the base plating layer and having a single layer structure comprising a member selected from organic resinous materials and mixtures of at least one of the organic resinous materials and chromium ions.

6. The composite steel strip as claimed in claim 1, wherein the corrosion resistant coating layer has a surface coating layer formed on the base plating layer and having a double layer structure consisting essentially of an under layer formed by applying a chromate treatment to the base plating layer surface and an upper layer formed on the under layer and comprising an organic resinous material.

7. The composite steel strip as claimed in claim 1, wherein the zinc alloy consists of Zn and at least one additional metal member selected from the group consisting of Fe, Co, Mn, Cr, Sn, Sb, Pb, Ni and Mo.

8. The composite steel strip as claimed in claim 1, wherein the base plating layer further contains a number of additional fine or colloidal particles comprising at least one member selected from the group consisting of $SiO_2$, $TiO_2$, $Cr_2O_3$, $Al_2O_3$, $ZrO_2$, $SnO_2$, and $Sb_2O_5$.

9. The composite steel strip as claimed in claim 3, wherein the additional particles are present in an amount of 0.1 to 30% based on the weight of the base plating layer.

10. The composite steel strip as claimed in claim 1, wherein the corrosion resistant coating layer has an additional thin electroplating layer formed on the base plating layer and comprising at least one member selected from the group consisting of Zn, Fe, Co, Ni, Mn and Cr.

11. The composite steel strip as claimed in claim 10, wherein the additional thin electroplating layer is present in an amount of 1 to 5 g/m$^2$.

12. The composite steel strip as claimed in claim 10, wherein the corrosion resistant coating layer has a surface coating layer formed on the additional thin electroplating layer and having a single layer structure comprising a member selected from organic resinous materials and mixtures of at least one of the organic resinous materials and chromium ions.

13. The composite steel strip as claimed in claim 10, wherein the corrosion resistant coating layer has a surface coating layer formed on the additional thin electroplating layer and having a double layer structure consisting essentially of an under layer formed by applying a chromate treatment to the base plating layer surface and an upper layer formed on the under layer and comprising an organic resinous material.

* * * * *